US008403870B2

(12) United States Patent
Vess

(10) Patent No.: US 8,403,870 B2
(45) Date of Patent: Mar. 26, 2013

(54) PORTABLE, SELF-CONTAINED COMPRESSION DEVICE

(75) Inventor: Mark A. Vess, Hanson, MA (US)

(73) Assignee: Covidien LP, Mansfield, MA (US)

( * ) Notice: Subject to any disclaimer, the term of this patent is extended or adjusted under 35 U.S.C. 154(b) by 716 days.

(21) Appl. No.: 12/559,546

(22) Filed: Sep. 15, 2009

(65) Prior Publication Data

US 2011/0066093 A1 Mar. 17, 2011

(51) Int. Cl.
*A61H 11/00* (2006.01)
*A61H 2011/005* (2006.01)

(52) U.S. Cl. ..... 601/134; 601/146; 601/151

(58) Field of Classification Search ..... 601/41, 601/43, 44, 84, 134, 148, 151, 152; 606/201, 606/202

See application file for complete search history.

(56) References Cited

U.S. PATENT DOCUMENTS 651,962 A 6/1900 Boghean
800,467 A 9/1904 Myers
814,795 A 3/1906 Myers
1,608,239 A 11/1926 Rosett
2,071,215 A 2/1937 Petersen
2,486,667 A 11/1949 Meister
2,528,843 A 11/1950 Poor
2,754,817 A 7/1956 Nemeth
2,773,498 A 12/1956 Himmelman
2,836,174 A 5/1958 Andrews
2,893,382 A 7/1959 Demeny
3,094,116 A 6/1963 Logan et al.
3,095,873 A 7/1963 Edmunds, Jr.
3,856,008 A 12/1974 Fowler et al.
3,935,984 A 2/1976 Lichowsky
4,206,765 A 6/1980 Huber
4,256,094 A 3/1981 Kapp et al.
4,304,225 A 12/1981 Freeman
4,448,190 A 5/1984 Freeman
4,577,622 A 3/1986 Jennings
4,838,263 A 6/1989 Warwick et al.
5,083,551 A 1/1992 Addison, Jr.
5,103,808 A 4/1992 Iams et al.
5,108,393 A 4/1992 Ruffa
5,226,874 A 7/1993 Heinz et al.
5,399,148 A 3/1995 Waide et al.
5,407,418 A 4/1995 Szpur
5,454,831 A 10/1995 McEwen
5,626,556 A 5/1997 Tobler et al.
5,738,637 A 4/1998 Kelly et al.
5,843,007 A 12/1998 McEwen et al.
5,916,183 A 6/1999 Reid
6,066,106 A 5/2000 Sherman et al.
6,142,962 A * 11/2000 Mollenauer et al. ..... 601/41

(Continued)

*Primary Examiner* — Quang D Thanh
(74) *Attorney, Agent, or Firm* — John Paul Mello, Esq.

(57) ABSTRACT

A portable, self-contained compression device is wearable by a person for applying intermittent compression on a limb of the person. The compression device comprises a sleeve having a longitudinal axis and adapted for placement on the limb. The device includes an actuator assembly on the sleeve comprising a flexible shaft operably connected to the sleeve and extending generally parallel to the longitudinal axis of the sleeve. The shaft is flexible to allow for conformance of the shaft to the limb when the sleeve is on the limb. The actuator assembly also comprises an actuator for rotating the flexible shaft in a first direction to constrict the sleeve to apply compression on the limb and for rotating the flexible shaft or allowing the flexible shaft to rotate in a second direction to relax constriction of the sleeve to relieve compression on the limb. Springs or elastic sections may be used to impart sequential, gradient compression on the limb.

9 Claims, 5 Drawing Sheets

U.S. PATENT DOCUMENTS

| | | | |
|---|---|---|---|
| 6,174,295 | B1 | 1/2001 | Cantrell et al. |
| 6,254,554 | B1 | 7/2001 | Turtzo |
| 6,325,771 | B1 | 12/2001 | Kelly et al. |
| 6,398,745 | B1 | 6/2002 | Sherman et al. |
| 6,447,465 | B1 | 9/2002 | Sherman et al. |
| 6,599,258 | B1 | 7/2003 | Bystrom et al. |
| 6,616,620 | B2 | 9/2003 | Sherman et al. |
| 6,620,116 | B2 | 9/2003 | Lewis |
| 6,645,163 | B2 | 11/2003 | Kelly et al. |
| 6,656,141 | B1 | 12/2003 | Reid |
| 6,676,613 | B2 | 1/2004 | Cantrell et al. |
| 6,709,410 | B2 | 3/2004 | Sherman et al. |
| 6,869,408 | B2 | 3/2005 | Sherman et al. |
| 6,926,682 | B2 | 8/2005 | Bystrom et al. |
| 6,939,314 | B2 | 9/2005 | Hall et al. |
| 6,939,315 | B2 | 9/2005 | Sherman et al. |
| 7,008,388 | B2 | 3/2006 | Sherman et al. |
| 7,056,297 | B2 | 6/2006 | Dohno et al. |
| 7,618,384 | B2 * | 11/2009 | Nardi et al. ..... 601/149 |
| 2002/0173735 | A1 | 11/2002 | Lewis |
| 2003/0009115 | A1 | 1/2003 | Sherman et al. |
| 2004/0073146 | A1 | 4/2004 | Weintraub et al. |
| 2004/0106884 | A1 | 6/2004 | Bolam et al. |
| 2005/0043657 | A1 | 2/2005 | Couvillon, Jr. |
| 2005/0080367 | A1 | 4/2005 | March et al. |
| 2006/0074362 | A1 | 4/2006 | Rousso et al. |
| 2007/0055188 | A1 | 3/2007 | Avni et al. |
| 2007/0083134 | A1 | 4/2007 | Ganti |
| 2007/0173886 | A1 | 7/2007 | Rousso et al. |
| 2008/0243041 | A1 | 10/2008 | Brenner et al. |
| 2008/0255481 | A1 | 10/2008 | Quntana et al. |
| 2008/0262399 | A1 | 10/2008 | Kovelman et al. |
| 2008/0319359 | A1 | 12/2008 | Moomiaie-Qajar et al. |

* cited by examiner

PORTABLE, SELF-CONTAINED COMPRESSION DEVICE

FIELD OF THE INVENTION

The present invention generally relates to compression devices, and more particularly to a portable, self-contained compression device having a flexible shaft that is rotatable to constrict a sleeve to apply compression on a limb.

BACKGROUND OF THE INVENTION

Compression garments for applying compressive forces to a selected area of a patient's anatomy are used in many situations. For example, compression garments may be used to treat venous insufficiency or edema, to heal wounds, or to prevent deep vein thrombosis (DVT).

Many devices on the market and in the prior art provide compression by using one or more pneumatic bladders that encircle the leg or other limb(s). The bladders are inflated in a predetermined sequence and to a prescribed pressure at timed intervals. The device that controls the inflation typically employs an air pump or compressor and a number of valves that operate to direct the flow of air to the bladders. Conventional products use a sleeve containing such bladders. The sleeve is wrapped around the limb and the bladder(s) are inflated by a controller device that resides separately from the patient such as on the footboard of a bed, on the floor, or on a night stand. If the patient must move, the sleeve must be removed. In addition, while the sleeve is on the patient, the tubes connecting the bladder and controller device may become entangled with the patient's limbs and/or become a nuisance or safety hazard to caregivers and visitors who may be close to the bed.

There is a need, therefore, for an improved compression device.

SUMMARY OF THE INVENTION

In one aspect, a portable, self-contained compression device of this invention is wearable by a person for applying intermittent compression on a limb of the person. The device comprises a sleeve having a longitudinal axis and is adapted for placement on the limb. An actuator assembly on the sleeve comprises a flexible shaft operably connected to the sleeve and extending generally parallel to the longitudinal axis of the sleeve. The shaft is flexible to allow for conformance of the shaft to the limb when the sleeve is on the limb. The actuator assembly further comprises an actuator for rotating the flexible shaft in a first direction to constrict the sleeve to apply compression on the limb and for rotating the flexible shaft or allowing the flexible shaft to rotate in a second direction to relax constriction of the sleeve to relieve compression on the limb.

In another aspect, the invention involves a method of applying compression on a limb of a person using a portable, self-contained compression device completely wearable by the person. The method comprises placing on the limb a sleeve having a flexible shaft connected to the sleeve that allows for conformance of the flexible shaft to the limb. The method further comprises rotating the flexible shaft in a first direction to constrict the sleeve to apply compression on the limb and rotating the flexible shaft or allowing the flexible shaft to rotate in a second direction to relax constriction of the sleeve to relieve compression on the limb. The flexible shaft is repeatedly rotated in the first direction and rotated or allowed to rotate in the second direction to apply intermittent compression on the limb.

In another aspect, a method of applying compression on a limb of a person using a portable, self-contained compression device completely wearable by the person comprises placing on the limb a sleeve having an actuator assembly on the sleeve. The actuator assembly includes a motor and a battery connected to the motor. The method further comprises moving a motor shaft of the motor via power from the battery in a first direction in which the motor shaft causes the actuator assembly to constrict the sleeve to compress the limb and generating electrical current by allowing the motor shaft to rotate in a second, opposite direction in response to a force on the sleeve from the compressed limb. The electrical current is used to charge the battery.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
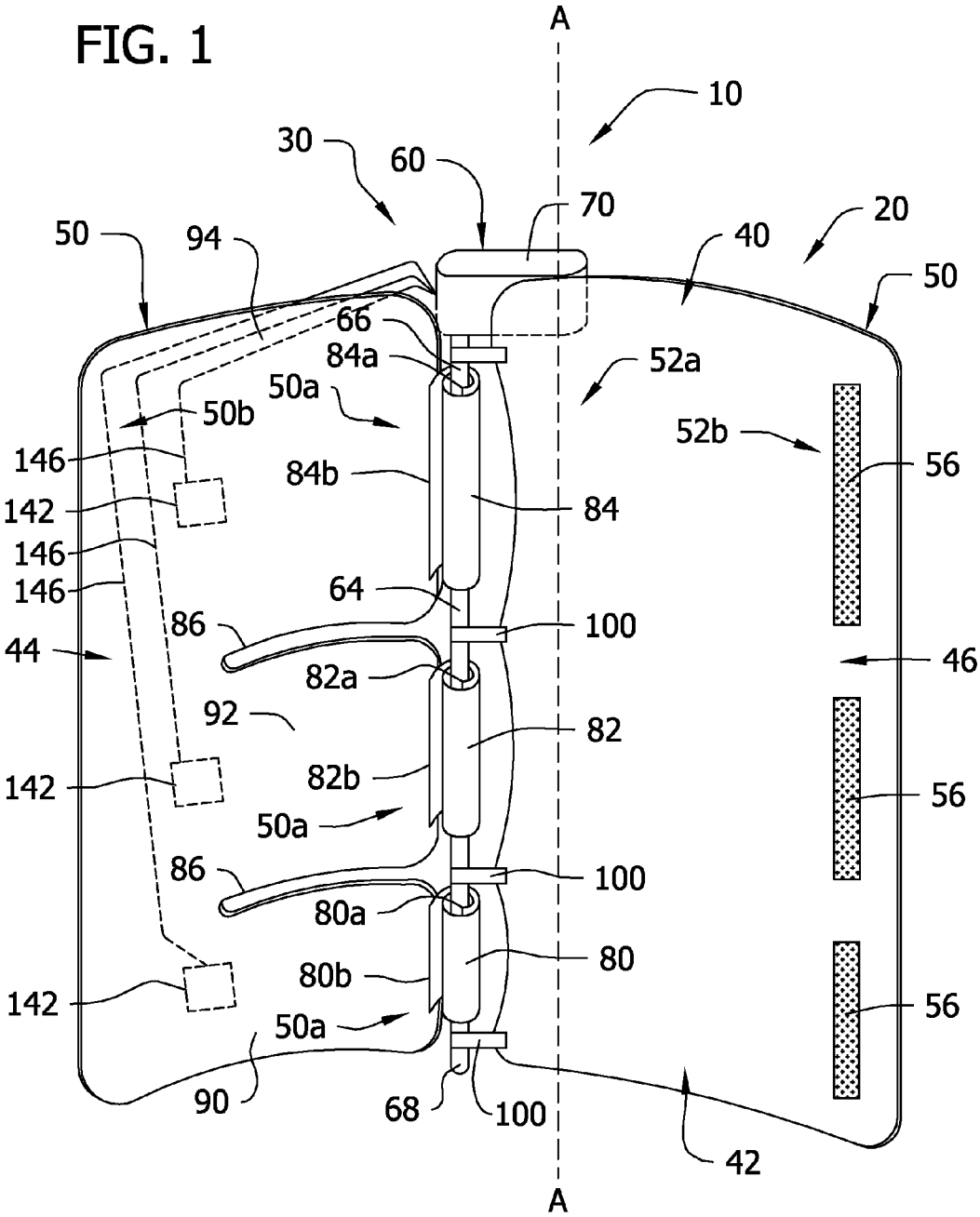
FIG. 1 is a perspective of a compression device of this invention.
Figure 2:
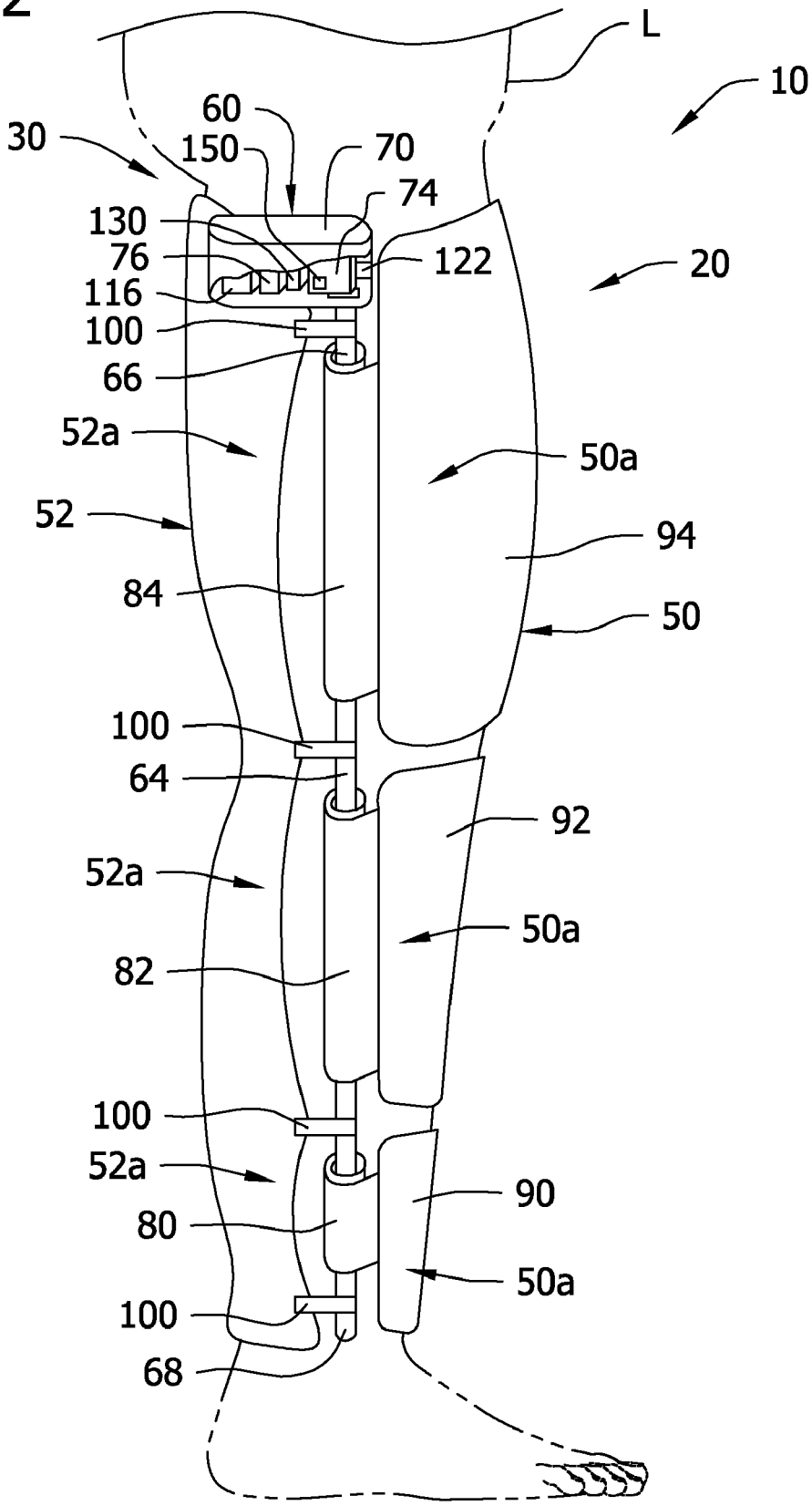
FIG. 2 is a perspective of the compression device of FIG. 1 placed on a limb.
Figure 3:
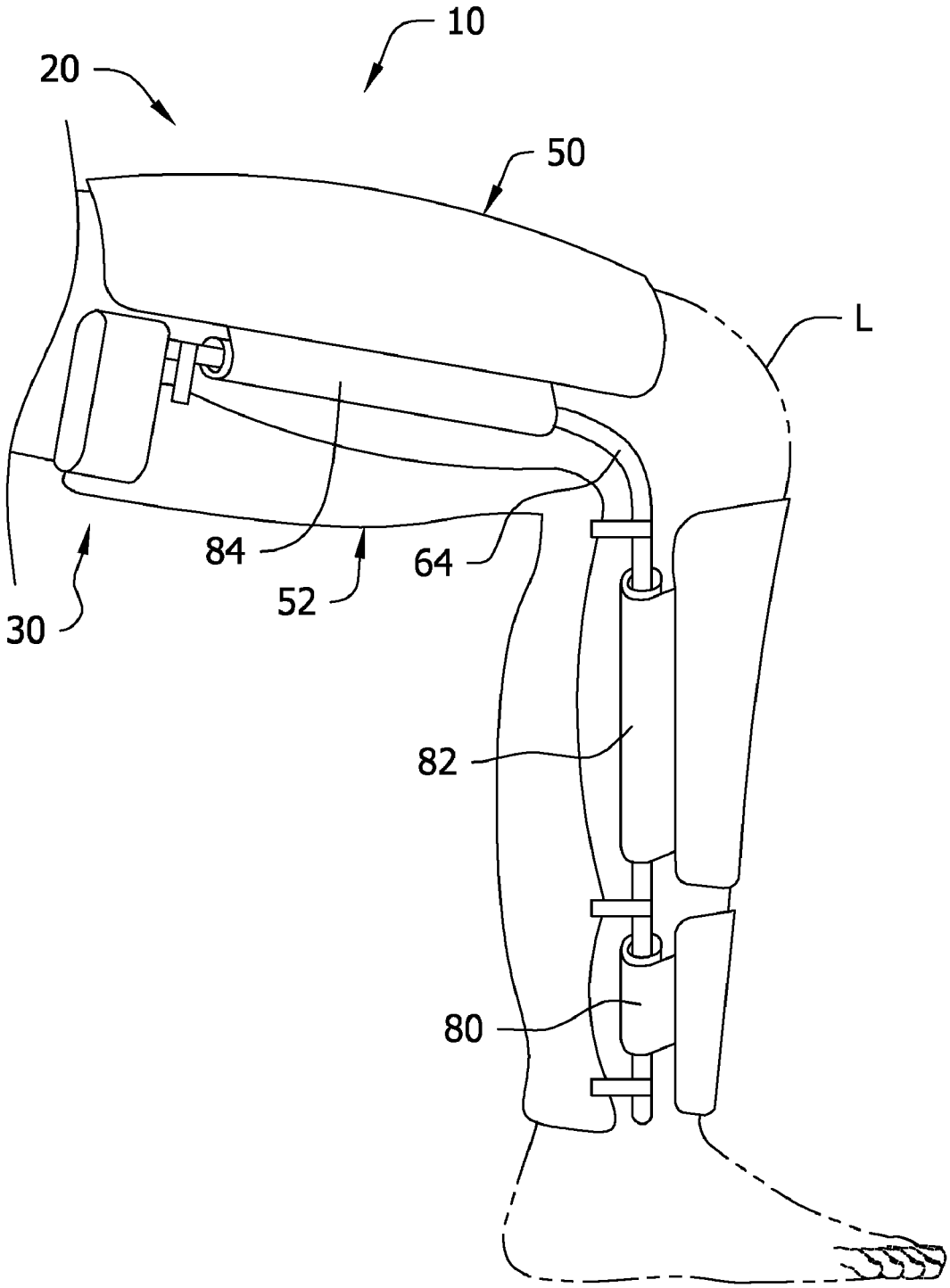
FIG. 3 is a perspective of the compression device on the limb, wherein the limb is bent.

Referring to the drawings, FIGS. 1-3 show one embodiment of a compression device of this invention, generally designated 10. As will be explained in detail hereinafter, the device 10 may be used for cyclically compressing a limb L of a patient to enhance venous and lymphatic flow. By way of example, the limb L may be a leg, foot or arm. The limb referred to herein and shown in FIGS. 2 and 3 is a leg, generally designated L.

In general, the device 10 comprises a sleeve 20 adapted for placement on a limb L. The device 10 includes an actuator assembly, generally designated 30, for constricting the sleeve 20 to apply compression on the limb L. The compression device 10 is portable and self-contained because the actuator assembly 30 is supported on the sleeve 20 and has a portable power source such as a battery. Thus, a patient is not "tethered" to a stationary controller or an electrical outlet while wearing the device, thereby providing greater patient mobility.

The sleeve 20 may be sized and shaped for encircling different limb lengths. For example, the sleeve 20 may be knee-length, for encircling a leg L from the ankle to below the knee. In the illustrated embodiment, the sleeve 20 is thigh-length, for encircling a leg L from the ankle to above the knee. The sleeve 20 comprises a proximal (top) end 40, a distal (bottom) end 42, and opposite sides 44, 46. As shown in FIG. 1, the illustrated embodiment comprises first and second sleeve portions 50, 52. Each sleeve portion 50, 52 comprises an inner side margin 50*a*, 52*a* and an outer side margin 50*b*, 52*b*, respectively. The sleeve 20 may have other configurations, such as three or more separate limb-encircling bands (not shown). The sleeve 20 is placed on a limb L by aligning a longitudinal axis A-A of the sleeve with the limb, wrapping the sides 44, 46 (outer side margins 50*b*, 52*b* of the sleeve portions 50, 52) around the limb, and securing the sides in an overlapping fashion using, for example, hook and loop fasteners 56. The sleeve 20 generally comprises a thin, soft, flexible and breathable material. However, other materials may be used.

The actuator assembly 30 comprises a controller 60 positioned near the proximal end 40 of the sleeve 20 and a flexible shaft 64 that extends generally parallel to the longitudinal axis A-A of the sleeve at a location generally between the two sleeve portions 50, 52. As described in further detail below, the flexible shaft 64 is connected to the sleeve 20 at locations along the length of the sleeve between a proximal end 66 and a distal end 68 of the shaft. The controller 60 comprises a housing 70 containing an actuator 74 and a control system 76. A portion of the controller housing 70 is broken away in FIG. 2 to reveal example positions of the actuator 74 and the control system 76 within the housing. The actuator 74 is operably connected to the proximal end 66 of the flexible shaft 64 for rotating the flexible shaft to constrict the sleeve 20 to apply compression on the limb L. The controller housing 70 is mounted on the sleeve 20 (e.g., mounted on the second sleeve portion 52) to stabilize the controller 60. Thus, the controller 60 is held from rotation with respect to the sleeve 20.

The actuator 74 rotates the flexible shaft 64 in a first direction (e.g., clockwise as viewed in FIG. 1) to constrict the sleeve 20 to apply compression on the limb L, and rotates the flexible shaft in a second direction (e.g., counterclockwise in FIG. 1) to relax constriction of the sleeve to relieve compression on the limb. Alternatively, the actuator 74 may not apply force to the flexible shaft tending to rotate the flexible shaft 64 in the second direction, but allow the shaft to rotate in the second direction in response to force against constriction of the sleeve from, for example, compressed tissue of the limb L. The actuator 74 may repeatedly rotate the flexible shaft 64 in the first direction and rotate the flexible shaft or allow the flexible shaft to rotate in the second direction to apply intermittent compression on the limb L.

The actuator may comprise a small electric motor, also indicated 74. The motor may be a brushless design or may be a stepper type motor. An example motor has an electrical load between approximately 10 to 25 watts. Desirably, the motor 74 is capable of driving the flexible shaft 64 at a rate of 56 rotations per minute with 40 ounce-inches of torque. Motors with other operational parameters may be used.

The actuator 74 may include a gearbox (also designated 74) to reduce the required motor speed so that a much smaller motor may be used. The gearbox 74 may contain, for example, a simple, plastic-cased, plastic/nylon-geared, planetary reduction or a plastic-cased, plastic/nylon-gear train. The planetary reduction or gear train desirably allows the motor 74 to generate sufficient torque for a motor shaft operably linked to the flexible shaft 64 to rotate the flexible shaft to impart sufficient compression on the limb L. The gearbox 74 has a ratio that not only allows the motor 74 to sufficiently drive the flexible shaft 64 but also allows the flexible shaft to be unwound or reversed easily to relax constriction of the sleeve 20, which is desirable to allow the reverse spin of the motor to charge a battery, as described in more detail below.

The illustrated flexible shaft 64 extends along substantially all of the length of the sleeve 20 and is flexible to allow for conformance of the shaft to the limb L when the sleeve is on the limb. For example, the shaft 64 is flexible to conform to the curved shape of a calf muscle. The shaft 64 may have sufficient flexibility to conform to the shape of the leg L when the leg is bent at the knee (see FIG. 3). For example, the shaft 64 may have flexibility allowing the shaft to bend up to 90 degrees or more than 90 degrees. Thus, the flexible shaft 64 may be configured to freely move and bend with the limb L so that the wearer may freely ambulate, sit or assume various other positions while wearing the device 10. The shaft 64 may also serve to help the sleeve 20 "stay up," or keep from collapsing upon itself, when placed on the limb L. The diameter of the illustrated flexible shaft 64 is approximately ⅛ of an inch, but other shaft diameters may be used. The flexible shaft 64 may comprise, for example, wound metal strands (e.g., a flex drive cable), an extruded, plastic or nylon rod, or a carbon fiber rod. The choice of material and stiffness for the flexible shaft 64 depends in part on the degree of flexibility necessary for the desired use of the particular compression device 10. The shaft 64 may or may not be configured to twist along its length when rotated. Desirably, the shaft 64 rotates at the same rate along its entire length (i.e., the shaft does not twist).

As shown in FIGS. 1-3 the actuator assembly 30 also comprises springs 80, 82, 84 mounted on the flexible shaft at spaced intervals. Inner ends 80*a*, 82*a*, 84*a* of the springs 80, 82 and 84 are connected to the flexible shaft 64, and outer ends 80*b*, 82*b*, 84*b* of the springs are connected to the inner side margin 50*a* of the first sleeve portion 50. In the illustrated embodiment, the actuator assembly 30 comprises an ankle spring 80, a calf spring 82 and a thigh spring 84. The springs 80, 82, 84 may comprise spirally wound flat springs (spiral leaf springs), but any type of spring may be used. In addition, the springs 80, 82, 84 may have sizes different from those illustrated. The springs 80, 82, 84 may be made of spring steel, nylon, plastic, carbon fiber, or another suitable material. When the flexible shaft 64 rotates in the first direction (e.g., clockwise as viewed in FIG. 1) to constrict the sleeve 20, the springs 80, 82, 84 rotate with the shaft 64 and tend to wind the inner side margin 50*a* of the first sleeve portion 50 around the springs.

Desirably, the springs 80, 82, 84 have successively decreasing spring rates from the distal end 68 of the flexible shaft 64 toward the proximal end 66 of the flexible shaft such that rotation of the shaft in the first direction causes sequential and gradient compression on the limb L. Desirably, the ankle spring 80 has a tighter, quicker wind than the calf spring 82, and the calf spring 84 has a tighter, quicker wind than the thigh spring. When the motor rotates the flexible shaft, the springs 80, 82, 84 first coil more tightly before applying substantial force tending to constrict the sleeve. When the flexible shaft 64 is rotated, the ankle spring 80 is wound tight first so that it is the first among the three springs 80, 82, 84 to constrict the sleeve 20. Upon further rotation of the flexible shaft 64, the calf spring 82 constricts the sleeve 20, and the thigh spring 84 follows. Slits 86 are formed in the first sleeve portion 50 so that sections 90, 92, 94 of the first sleeve portion 50 associated with each spring 80, 82, 84 may be constricted independently of each other. In other words, the sections 90, 92, 94 are independently movable circumferentially of the leg L with respect to one another. As a result, sequential constriction of the sleeve 20 occurs, and the maximum pressure applied by the sleeve increases progressively from the ankle spring 80 to the thigh spring 84.

The second sleeve portion 52 is connected at its inner side margin 52*a* to the flexible shaft by at least one bearing connection 100. In the illustrated embodiment, four bearing connections 100 are used. The connections 100 allow the flexible shaft 64 to rotate without winding the inner side margin 52*a* of the second sleeve portion around the flexible shaft.

Although the connections 100 are free to rotate about the flexible shaft 64, the connections desirably maintain their general longitudinal position along the flexible shaft. The bearing connections 100 may have various configurations. For example, the connections 100 may comprise fabric loops, also indicated 100, which extend around the flexible shaft 64 and ends of which are attached to the second sleeve portion 52. Alternatively, the second sleeve portion 52 may be connected to one or more tubes (not shown) positioned over part or substantially all of the length of the flexible shaft 64. Other bearing connections 100 may be used.

The sleeve 20 may be releasably connected to the actuator assembly 30 so the actuator assembly may be used with disposable sleeves. For example, the controller housing 70 may be releasably mounted on the sleeve 20. In addition, the inner side margin 50*a* of the first sleeve portion 50 may be connected to the springs 80, 82, 84 by hook and loop fabric (not shown) or another type of releasable connection. Moreover, the inner side margin 52*a* of the second sleeve portion 52 may be releasably connected to the bearing connections 100 such as by hook and loop material (not shown). Alternatively, the springs 80, 82, 84 and/or the bearing connections 100 may be permanently attached to the inner side margin 50*a* of the first sleeve portion 50 and to the inner side margin 52*a* of the second sleeve portion, respectively. Thus, the flexible shaft 64 would be removable from the springs 80, 82, 84 and the bearing connections 100 on the sleeve. Such configurations allow the entire sleeve 20 or sleeve portions 50, 52 to be easily replaced. In addition, such releasable connections allow the sleeve 20 to be secured around a limb L by connection of the sleeve 20 to the flexible shaft 64, instead of by wrapping the outer side margins 50*b*, 52*b* around the limb and securing them in an overlapping fashion, as described above.

Figure 4:
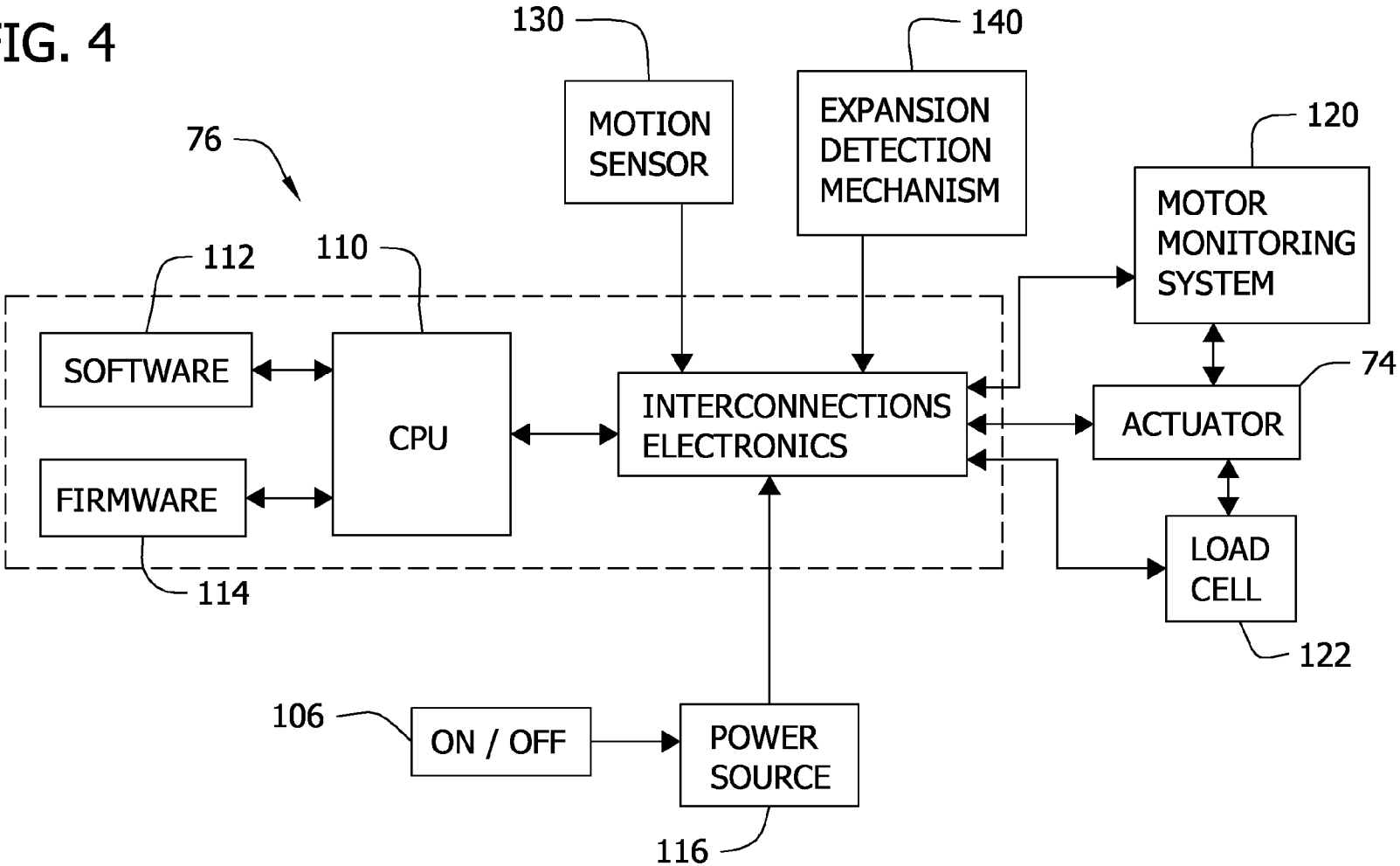
FIG. 4 is a schematic diagram of an example control system for controlling operation of a compression device of this invention.

FIG. 4 shows a schematic diagram of an example control system 76 for use with a compression device 10 of the present invention. The control system 76 has an on/off switch 106 and comprises a central processing unit (CPU) 110, such as a microprocessor or the like for executing computer-implemented instructions in the form of software 112 and/or firmware 114. In one embodiment, the CPU 110 provides control signals to operate the actuator 74 and to carry out a desired compression treatment regimen. The control system 76 communicates with its power source 116 (e.g., a battery) via interconnection electronics 118. The interconnection electronics 118 transmit signals from the CPU 110 to the actuator 74 over, for example, electrical or fiber optic lines. In addition, the CPU 110 receives information from other sources, described in further detail below, via the interconnection electronics 118 over the same or similar lines.

The control system 76 may be programmed to monitor feedback data from the actuator 74 and programmed to set operational parameters of the compression device 10 based on the feedback data. For example, the control system 76 may monitor venous refill time, venous refill volume, actuator current, actuator voltage, and/or actuator force. Feedback data may be collected by a motor monitoring system 120 that measures motor current. For example, the motor monitoring system may include a current shunt resistor (also indicated 120) placed in series with drive circuits of the motor, which will be understood by one having ordinary skill in the art. The resistor 120 is used to collect voltage measurements, which correspond to the amount of load supplied by the motor 74. The controller 60 is programmed to use these voltage measurements to set speed and torque of the motor 74. In addition, a load cell 122 may be used within the controller housing 70 to measure the torsional forces on the motor 74. For example, as shown in FIG. 2, the load cell 122 may be positioned between the motor 74 and the controller housing 70 so that one or more strain gauges (not shown) within the load cell are positioned to measure the torsional forces on the motor.

Using the motor monitoring system 120 and/or the load cell 122, feedback data is collected during constriction of the sleeve 20 and/or during venous refill. To measure data relating to venous refill, a minimal amount of compression is maintained on the limb L at the end of a compression cycle, as controlled by the CPU 110 based on measurements received from the motor monitoring system 120 and/or the load cell 122. The minimal compression maintained on the limb L may comprise approximately 10 mmHg of pneumatic compression or about eight ounce-inches of torque on the flexible shaft 64. As blood returns to the limb L, the limb applies a force against the sleeve 20 that generates a small amount of reverse torque on the flexible shaft 64 and thus the actuator 74. An increase in effort to maintain the minimal amount of compression as the blood returns to the limb is measured by the motor monitoring system 120 and/or load cell 122 and recognized by the CPU 110 as venous refill data.

The increased effort may be measured in various ways. For example, the current shunt 120 may be used to measure the resulting higher current. The controller 60 recognizes the additional voltage across the shunt 120 as venous refill data. Alternatively, the controller 60 may recognize voltage created by the load cell 122 corresponding to the torsional and compressive forces of the motor and/or gearbox 74. If the load cell is used, the minimal compression on the limb L is maintained by locking the rotor of the motor so that forces (e.g., torque) experienced by the flexible shaft 64 are transmitted to the motor and/or gearbox 74 and sensed by the load cell 122. At the completion of venous refill, the controller 60 recognizes less voltage across the shunt 120 and/or from the load cell 122. The controller 60 then uses the venous refill data to calculate venous refill time and/or volume.

The control system 76 may set at least one operational parameter of the compression device 10 based on the monitored feedback data. For example, the control system 76 may set frequency of sleeve constriction, magnitude of sleeve constriction, or duration of sleeve constriction. For example, the CPU 110 may be programmed to set the operational parameters by comparing measured values from the motor monitoring system 120 and/or load cell 122 to stored target values for various compression therapy regimens. These operational parameters may be set at the end of each compression cycle (i.e., after each time the flexible shaft 64 is rotated or allowed to rotate in the second direction) or at other intervals.

The compression device 10 may also include at least one motion sensor 130 (e.g., accelerometer). The motion sensor 130 may be located anywhere on the device 10, but is shown in the illustrated embodiment within the controller housing 70 (FIG. 2). The motion sensor 130 is capable of monitoring and communicating to the controller 60 whether a person wearing the compression device 10 is ambulatory. Compression therapy is generally not required when the wearer is ambulatory. The controller 60 is programmed to discontinue intermittent compression on the limb L when the person has been ambulatory for a certain period of time (e.g., 1, 3, 5, 7 or 10 minutes). Thus, battery life may be conserved when the wearer is ambulatory. In addition, the motion sensor 130 communicates to the controller 60 when the limb L has been stationary for a certain period of time (e.g., 1, 3, 5, 7 or 10 minutes), in response to which the controller resumes rotating the flexible shaft 64 in the first direction and rotating the flexible shaft or allowing the flexible shaft to rotate in the second direction.

In another feature, the compression device 10 may include an expansion detection mechanism 140. The expansion detection mechanism is capable of detecting when the sleeve 20 is in a condition having a certain amount of irreversible expansion. In this regard, the life of the sleeve 20 may be deliberately limited because of the fiber design and construction of the soft sleeve material. As the fibers break down, the sleeve 20 may tear or stretch beyond acceptable limits. The expansion detection mechanism may comprise, for example, at least one sensor 142 (e.g., strain gauge sensor) applied to the surface of the sleeve 20 or woven into the sleeve fabric.

As shown in FIG. 1, in the illustrated embodiment, three sensors 142 are positioned on the sleeve 20 to detect expansion of the ankle section 90, the calf section 92, and the thigh section 94. Other combinations and locations of sensors 142 may be used. The expansion detection mechanism 140 recognizes expansion of the sleeve 20 due to tearing or stretching, for example, and communicates the condition to the controller 60. The controller 60 may be programmed to signal the existence of the condition to the wearer or inhibit operation of the compression device 10 when the condition exists.

Each sensor 142 may comprise a conductive/resistive coating (e.g., sprayed-on powdered carbon) or conductive/resistive fibers on the sleeve 20. The coating and the fibers are carbon-based and therefore offer a resistive electrical path through them. As the material of the sleeve 20 is stretched or torn, the coating and/or fibers of the sensors 142 permanently elongate and thus increase in resistance. The sensors 142 are oriented on the sleeve 20 along an axis of expansion (e.g., transversely to longitudinal axis A-A) to maximize their sensitivity to fiber tears of the sleeve material.

The conductive/resistive coating or fibers of each sensor 142 is electrically connected to resistance measuring circuits in the controller 60 via fully conductive, printed-on traces or printed circuits 146 on the sleeve 20. The printed circuits are fully conductive even when stretched out by a failing/tearing sleeve 20. As shown in FIG. 1, the printed circuits 146 are placed on the sleeve 20 generally perpendicular to the direction of expansion. This exposes the printed circuits 146 to a minimal amount of sleeve expansion.

The result of this electrical design and construction is to allow continued electrical resistive measurement by the sensors 142 as the sleeve 20 begins to tear apart. As the sleeve 20 begins to tear apart, the combined system of the conductive/resistive coating or fibers of the sensors 142 and the fully conductive printed/woven conductors 146 measures a rapid increase in resistance. This substantial increase in resistance is measured by the controller 60 and recognized as a failing sleeve 20.

In another embodiment, the motor 74 is equipped with an optical encoder 150 used to detect sleeve expansion. The optical encoder 150 counts the number of rotations of the motor 74 during each constriction cycle of the controller 60. The rotations of the motor 74 are indicative of the number of revolutions of the flexible shaft 64 required to complete a compression cycle. The CPU 110 stores this data and averages the number of revolutions required per cycle. A new average is calculated beginning each time the controller 60 is re-started because the required revolutions is dependant on the particular application (e.g., orientation or tightness) of the sleeve 20 on the limb L and the specific installation of the sleeve on the flexible shaft 64. If the sleeve 20 begins to fail, the number of revolutions required to complete a compression cycle will increase. The CPU 110 may be programmed with an algorithm to recognize the increase in required revolutions and to signal the existence of the condition to the wearer, inhibit operation of the compression device 10 whenever the condition exists, or take any other required action.

In yet another feature, the controller 10 is capable of energy recovery. As the motor 74 executes a compression cycle, the motor draws power from the battery 116. More specifically, the controller 10 causes the motor shaft operably linked to the proximal end 66 of the flexible shaft 64 to rotate the flexible shaft in the first direction to constrict the sleeve 20 to compress the limb L. When the compression cycle is finished, the controller 60 allows the reverse force exerted by the springs 80, 82, 84 and/or the compressed limb L to cause the motor shaft to rotate in the second direction. This rotation in the second direction generates electrical current that is used to charge the battery 116. Thus, the motor 74 is used as a generator.

In one cycle of use, the compression device 10 is placed on a limb L by aligning the longitudinal axis A-A of the sleeve 20 with the limb L, wrapping the sleeve sides 44, 46 around the limb, and securing the sides in an overlapping fashion using the hook and loop fasteners 56. The controller 60 is then activated to provide signals to operate the actuator 74 to carry out a desired compression treatment regimen. The actuator 74 repeatedly rotates the flexible shaft 64 in the first direction (e.g., clockwise as viewed in FIG. 1) to constrict the sleeve 20 to apply compression on the limb L, and rotates the flexible shaft 64 in the second direction (e.g., counterclockwise in FIG. 1) or allows the flexible shaft to rotate in the second direction to relax constriction of the sleeve to relieve compression on the limb. The device 10 applies sequential, gradient compression via the springs 80, 82, 84. The motor (actuator) 74 may generate energy as the flexible shaft 64 rotates in the second direction. The control system 76 may monitor feedback data from the actuator 74 and set operational parameters of the compression device 10 based on the feedback data. The motion sensor 130 may be used to communicate to the controller 60 whether a person wearing the compression device 10 is ambulatory, and the controller may start or stop compression treatment accordingly. In addition, the expansion detection mechanism 140 may be used to detect when the sleeve 20 is in a condition having a certain amount of irreversible expansion so that the controller 60 may signal the existence of the condition to the wearer or inhibit operation of the compression device 10 when the condition exists.

Figure 5:
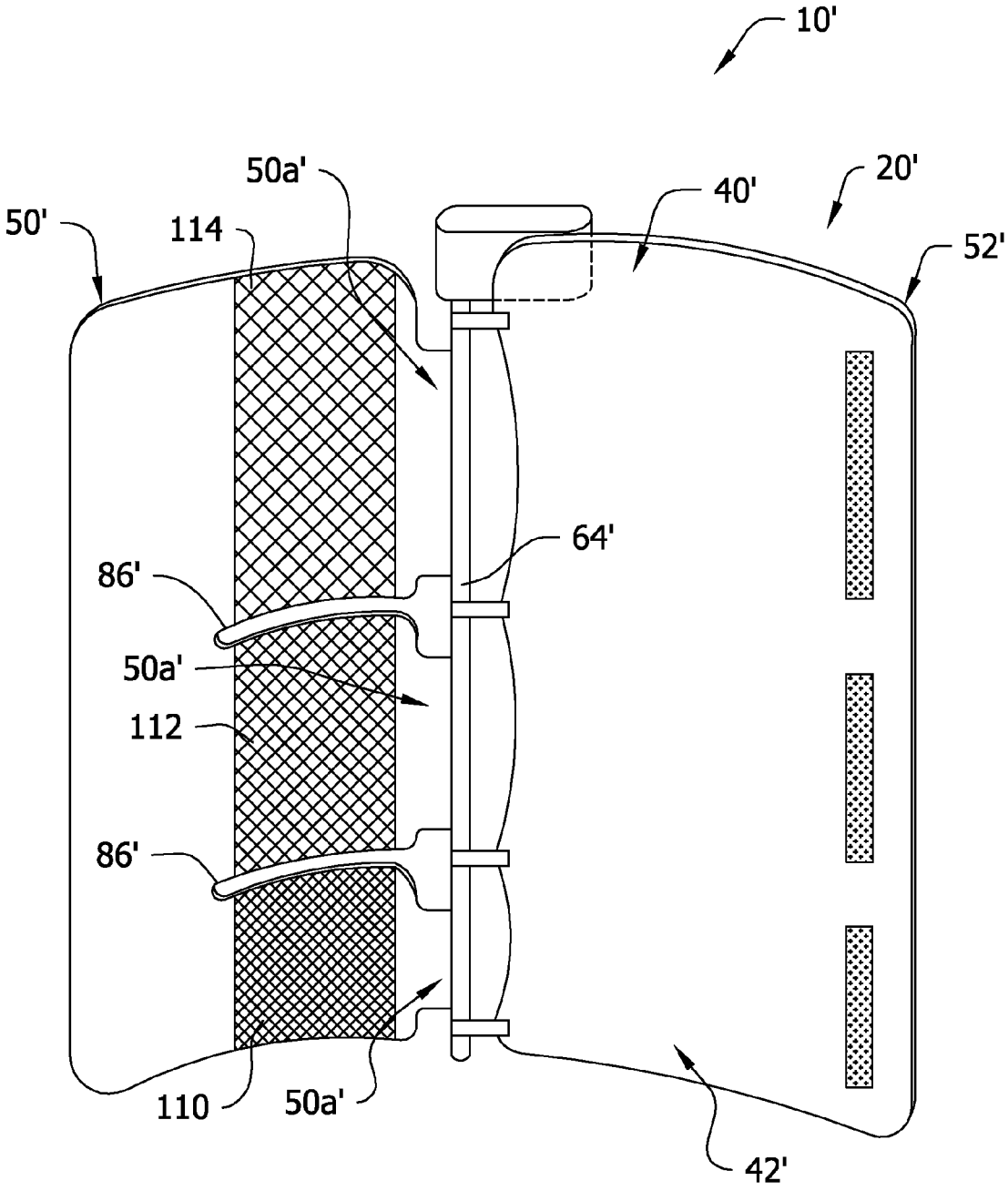
FIG. 5 is a front perspective of another embodiment of a compression device of this invention.

FIG. 5 shows another embodiment of a compression device 10'. The device 10' is similar in many respects to the device 10 described above, and corresponding parts are designated by the corresponding reference numbers, plus a prime designator (’). In this embodiment, the sleeve 20' comprises elastic sections 110, 112, 114 positioned and spaced along the length of one of the sleeve portions 50', 52' of the sleeve 20' (sleeve portion 50' in FIG. 4). In the illustrated embodiment, the sleeve 20' has an elastic ankle section 110, an elastic calf section 112, and an elastic thigh section 114. The elastic sections 110, 112, 114 have successively decreasing elasticities from the distal end 42' of the sleeve to the proximal end 40' of the sleeve 20'. For example, the elastic ankle section 110 has the least elasticity, the elastic calf section 112 is more elastic, and the thigh section 114 has the most elasticity. Slits 86' are formed between the elastic sections 110, 112, 114 so that the sections are movable circumferentially of the leg L with respect to one another. In this embodiment, the inner side margin **50*a*' of the first sleeve portion is connected directly to the flexible shaft 64', not to springs on the shaft. Thus, rotation of the flexible shaft 64' in the first direction (e.g., clockwise as viewed in FIG. 4) tends to wind the inner side margin 50*a*' around the flexible shaft 64' to constrict the sleeve 20' to apply sequential, gradient compression on the limb L. Rotation of the flexible shaft 64' in the second direction (e.g., counterclockwise in FIG. 1) relaxes constriction of the sleeve 20'** to relieve compression on the limb L.

The compression device 10' is used much the same way as the sleeve 10. However, instead of using springs, the device 10' uses the elastic sections 110, 112, 114 to impart sequential, gradient compression.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A portable, self-contained compression device wearable by a person for applying intermittent compression on a limb of the person, the compression device comprising:

a sleeve adapted for placement on the limb, the sleeve having a longitudinal axis;

an actuator assembly on the sleeve, said actuator assembly comprising:

a flexible shaft operably connected to the sleeve and extending generally parallel to the longitudinal axis of the sleeve, said shaft being flexible to allow for conformance of the shaft to the limb when the sleeve is on the limb;

an actuator for rotating the flexible shaft in a first direction to constrict the sleeve to apply compression on the limb, and for rotating the flexible shaft or allowing the flexible shaft to rotate in a second direction to relax constriction of the sleeve to relieve compression on the limb; and springs mounted on the flexible shaft at spaced intervals, a first end of each spring being connected to the flexible shaft and a second end of each spring being connected to a portion of the sleeve.

2. A compression device as set forth in claim 1 wherein the sleeve has a length generally parallel to the longitudinal axis of the sleeve, and wherein the flexible shaft extends along substantially all of said length of the sleeve.

3. A compression device as set forth in claim 1 wherein the sleeve is bladderless.

4. A compression device as set forth in claim 1 wherein the springs have successively decreasing spring rates from a distal end of the flexible shaft toward a proximal end of the flexible shaft such that rotation of the flexible shaft in the first direction causes gradient compression on the limb.

5. A compression device as set forth in claim 1 further comprising a controller operably connected to the actuator, the controller being programmed to monitor feedback data from the actuator, and the controller being programmed to set an operational parameter of the compression device based on said feedback data.

6. A compression device as set forth in claim 5 wherein said feedback data associated with compression of the limb includes at least one of venous refill time, venous refill volume, actuator current, actuator voltage, and actuator force.

7. A compression device as set forth in claim 5 wherein said operational parameter of the compression device includes at least one of frequency of sleeve constriction, magnitude of sleeve constriction, and duration of sleeve constriction.

8. A compression device as set forth in claim 1 further comprising a motion sensor and a controller on the sleeve, the motion sensor being capable of monitoring and communicating to the controller whether a person wearing the compression device is ambulatory, the controller being programmed to discontinue intermittent compression on the limb when the person has been ambulatory for a certain period of time.

9. A compression device as set forth in claim 1 further comprising an expansion detection mechanism and a controller on the sleeve, the expansion detection mechanism being capable of detecting when the sleeve is in a condition having a certain amount of irreversible expansion, and the controller being programmed to signal the existence of the condition or inhibit operation of the compression device when the condition exists.

* * * * *